US006551140B2

(12) United States Patent
Billman et al.

(10) Patent No.: US 6,551,140 B2
(45) Date of Patent: Apr. 22, 2003

(54) ELECTRICAL CONNECTOR HAVING DIFFERENTIAL PAIR TERMINALS WITH EQUAL LENGTH

(75) Inventors: Timothy B. Billman, Dover, PA (US); Andrew C. Cheng, Diamond Bar, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/852,949

(22) Filed: May 9, 2001

(65) Prior Publication Data

US 2002/0168898 A1 Nov. 14, 2002

(51) Int. Cl.[7] ..... H01R 13/648

(52) U.S. Cl. ..... 439/608

(58) Field of Search ..... 439/608, 701, 439/408

(56) References Cited

U.S. PATENT DOCUMENTS

| | | | | | |
|---|---|---|---|---|---|
| 5,993,259 | A | * | 11/1999 | Stokoe et al. | 439/608 |
| 6,083,047 | A | * | 7/2000 | Paagman | 439/608 |
| 6,146,202 | A | * | 11/2000 | Ramey et al. | 439/608 |
| 6,231,391 | B1 | * | 5/2001 | Ramey et al. | 439/608 |
| 6,293,827 | B1 | * | 9/2001 | Stokoe | 439/608 |
| 6,343,955 | B2 | * | 2/2002 | Billman et al. | 439/608 |

* cited by examiner

*Primary Examiner*—Gary Paumen
(74) *Attorney, Agent, or Firm*—Wei Te Chung

(57) ABSTRACT

An electrical connector comprises a wafer integrally formed with a pair of terminal pairs and each pair configured by first and second terminals. The first terminal includes a first base portion having a first tail portion, and a first mating portion, the first tail and mating portions extending beyond the wafer. The second terminal includes a second base portion having a second tail portion, and a second mating portion, the second tail and mating portions extending beyond the wafer; wherein the first and second base portions of the first and second terminal are spaced apart from each other in a side-by-side arrangement.

16 Claims, 15 Drawing Sheets

ELECTRICAL CONNECTOR HAVING DIFFERENTIAL PAIR TERMINALS WITH EQUAL LENGTH

FIELD OF THE INVENTION

The present invention relates to an electrical connector, and more particular to a very high-density modular connector having a pair of differential pair with equal length, thereby effectively eliminating skew during signal transmission.

DESCRIPTION OF THE PRIOR ART

High-density electrical connector for use with printed circuit boards has been increasing required by the market in light of the increasing use of the servers, and the storage box.

U.S. Pat. No. 5,993,259 discloses an electrical connector of such application. The connector disclosed in the '259 patent includes a plurality of modularized wafers bounded together. As shown in FIG. 4 of the '259 patent, the terminals are stamped from a metal sheet, then embedded within an insulative material to form the wafer. However, it can be readily seen from FIG. 4 that the length of each terminal is different from its adjacent terminal because of the right-angle arrangement. In addition, it would be unlikely to make two adjacent terminals with equal length. As long as the terminal length is different from one another, skew between terminals is therefore inevitable.

In addition, it will be difficult to have two adjacent terminals to be configured as a differential pair. By the way, because of the shape of the terminals, it is also unlikely to reach equal impedance between two adjacent terminals.

U.S. Pat. No. 6,083,047 discloses an approach to make a high-density connector by introducing the use of printed circuit board. According to teaching of the '047 patent, conductive traces are formed on surfaces of the printed circuit board in a mirror-image arrangement, typically shown in FIG. 12. Again, the conductive traces formed on the surface of the printed circuit board are unlikely to have the same length. Skew is still inevitable.

In addition, in the above-described patent, distance between two adjacent terminals is too close to intercept a ground contact or conductive trace.

In the '259 patent, even a ground bus is provided, however, the ground bus only electrically separate two adjacent wafers, while it can not separate two adjacent terminals.

In the '047 patent, since the conductive traces are exposed on the printed circuit board, arranging a ground bus between two printed circuit boards. According to the teaching of the '047, insulative spacer is arranged to two adjacent printed circuit boards, this will not doubt increase the thickness of the overall dimension of the connector, especially when ground buses are arranged therein.

In addition, when the conductive traces are formed on the printed circuit boards, connecting legs/sockets have to be attached to corresponding conductive trace. This will not doubt complicate the make of the connector.

In the '047 patent, even the conductive-traces formed on both sides of the printed circuited board, since the connecting portion and tail portions are soldered thereto, the it will be unlikely to reach equal impedance between two terminals.

SUMMARY OF THE INVENTION

It is an objective of this invention to provide an electrical connector of high density in which terminal pair within an individual wafer has equal length.

It is still the objective of this invention to provide an electrical connector in which two adjacent wafers are separated by a grounding bus having ground ribs extending two adjacent terminals thereby providing excellent shielding for signal transmission.

In order to achieve the objective set forth, an electrical connector in accordance with the present invention comprises a wafer integrally formed with a pair of terminal pairs and each pair configured by first and second terminals. The first terminal includes a first base portion having a first tail portion, and a first mating portion, the first tail and mating portions extending beyond the wafer. The second terminal includes a second base portion having a second tail portion, and a second mating portion, the second tail and mating portions extending beyond the wafer; wherein the first and second base portions of the first and second terminal are spaced apart from each other in a side-by-side arrangement.

According to another embodiment of the present invention, an electrical connector in accordance with the present invention comprises at least a pair of wafers integrally formed with a plurality of terminals therein, the each wafer defining at least two openings adjacent to a terminal; and a first grounding bus is located between the wafers and forming at least a pair of grounding ribs extending into the openings of the wafer.

SUMMARY OF THE DRAWINGS

Other objects and further features of the present invention will be apparent from the following detailed description when read in conjunction with the accompanying drawings, in which.

DETAILED DESCRIPTION OF PREFERRED EMBODIMENTS

Figure 1A:
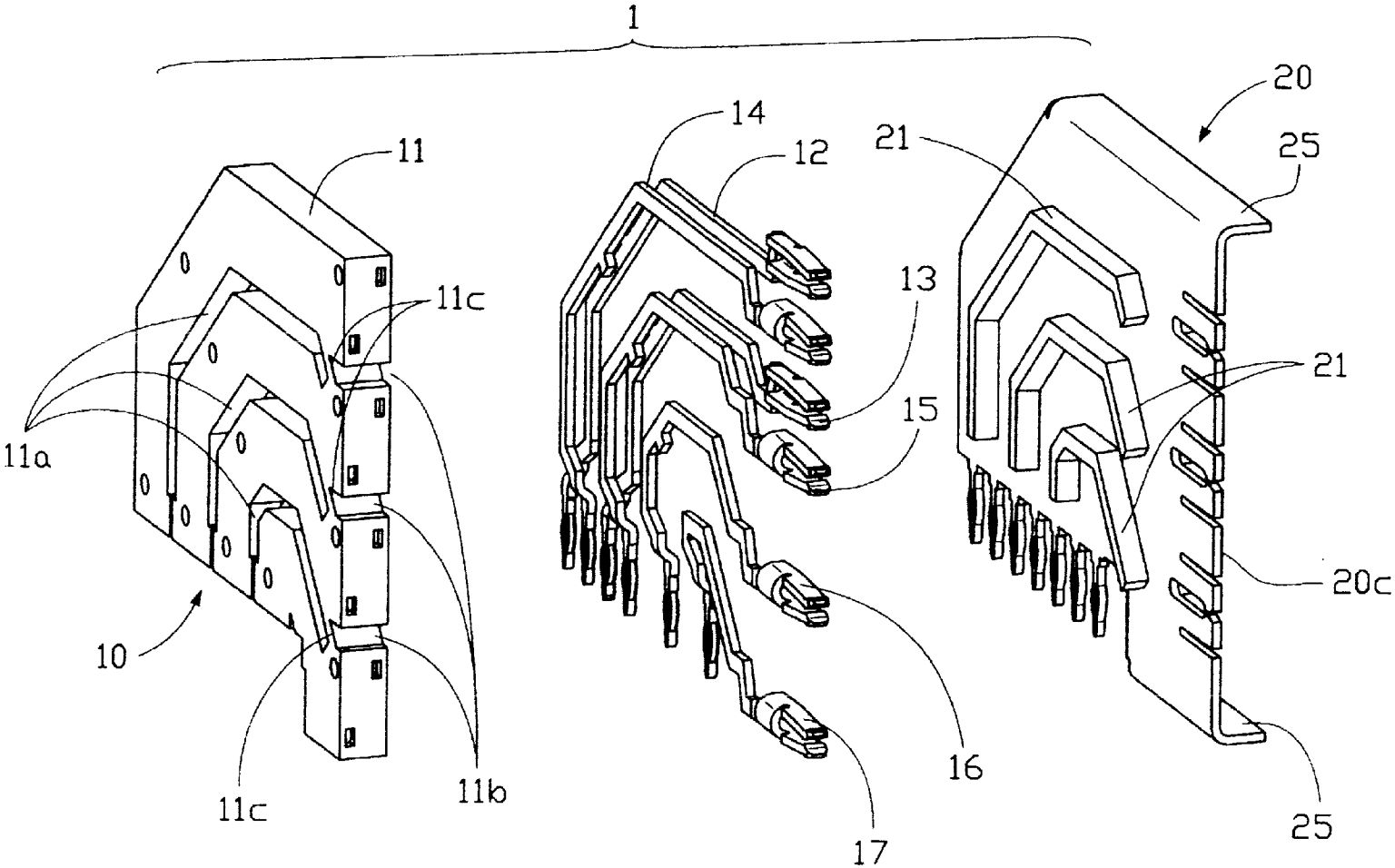
FIG. 1A is an exploded view of a wafer and a grounding bus in accordance with the present invention.
Figure 1C:
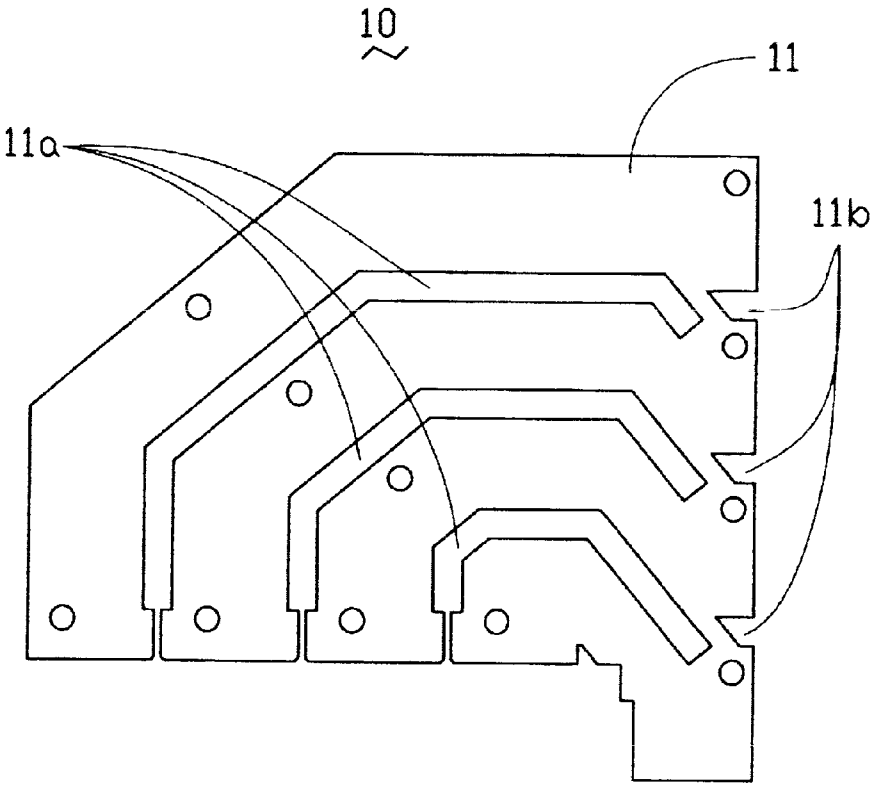
FIG. 1C is a front view of FIG. 1B.
Figure 1B:
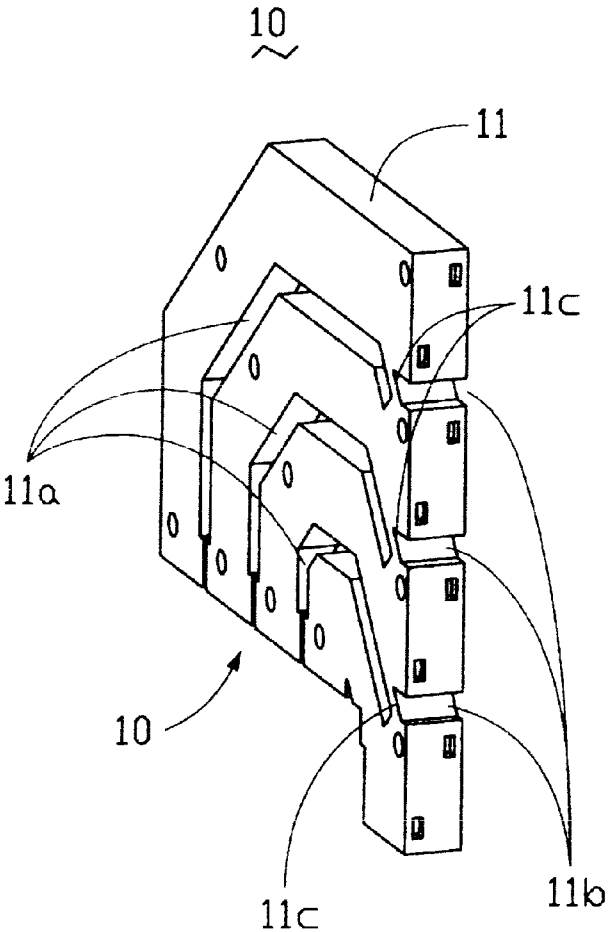
FIG. 1B is a perspective view of an insulative slab of FIG. 1A.

Referring to FIGS. 1A to 1L, 2, 3A and 3B, an electrical connector 1 in accordance with the present invention includes a wafer 10 in accordance with the present invention includes an insulative slab 11 and a plurality of terminals 12, 13, 14, 15, 16 and 17 integrally molded/embedded within the slab 11. A grounding bus 20 is provided and use with the wafer 10 for EMI shielding. When a plurality of wafers 10 is used together, the grounding bus 20 provides necessary shield. The grounding bus 20 includes a plurality of grounding ribs 21 extending therefrom. An electrically shielded passage 22 is defined between two adjacent grounding ribs 21. Detailed description will be given later.

Figure 1D:
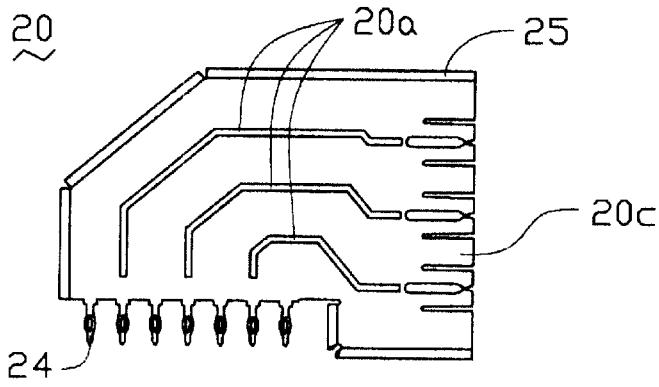
FIG. 1D is a front view of a ground bus of FIG. 1B without grounding ribs removed therefrom.
Figure 1E:
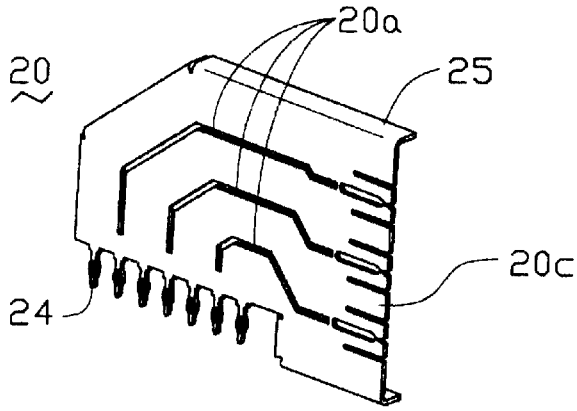
FIG. 1E is a perspective view FIG. 1E.
Figure 1F:
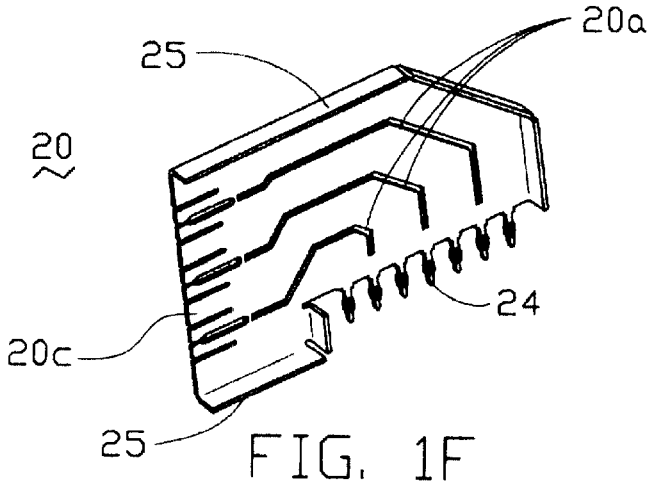
FIG. 1F is similar to FIG. 1E and viewed from a reverse direction.
Figure 1L:
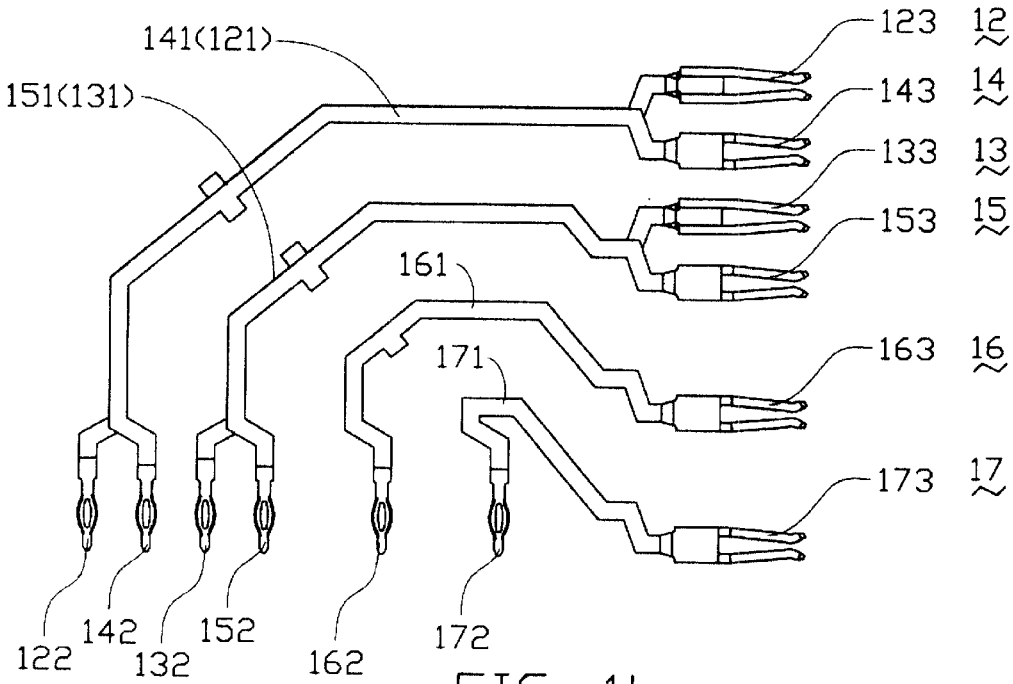
FIG. 1L is a front view showing first and second groups of terminals are arranged together without insulative slab enclosed thereon.
Figure 1G:
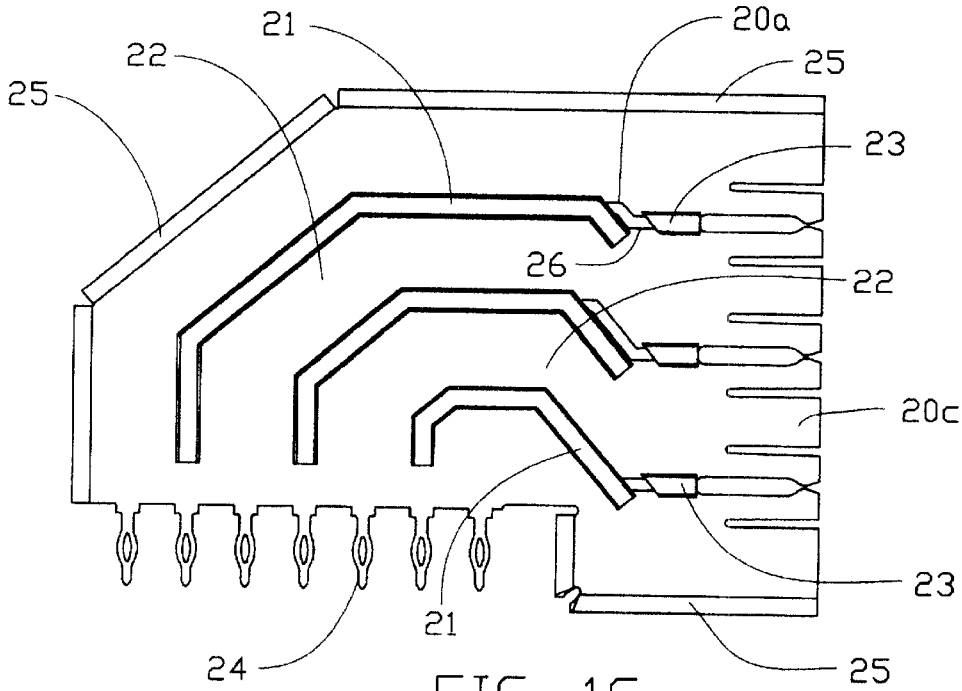
FIG. 1G is similar to FIG. 1D with grounding ribs formed thereon.
Figure 1H:
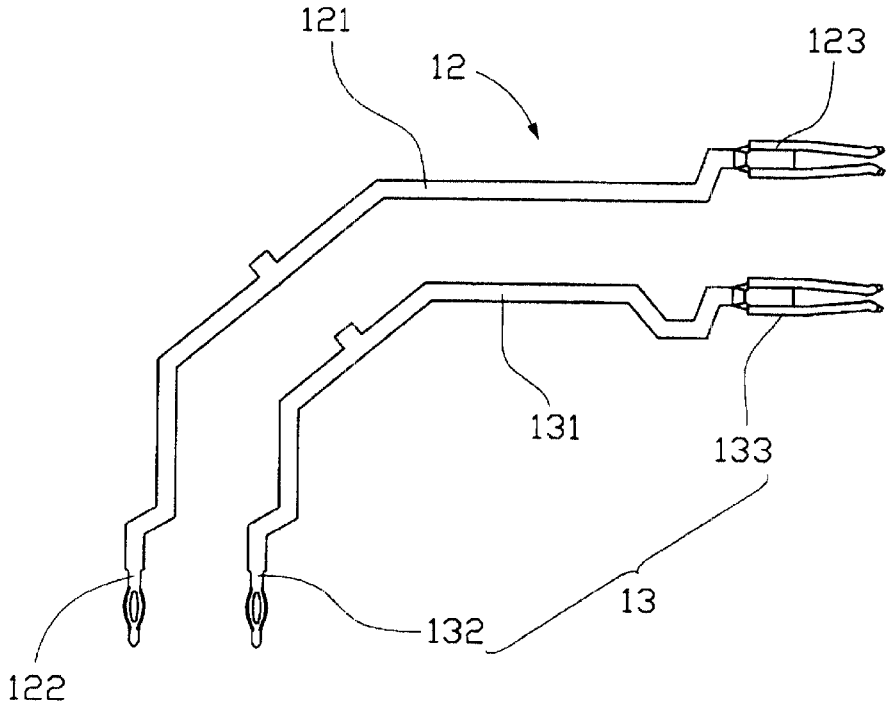
FIG. 1H is a front view first group of terminals.
Figure 1I:
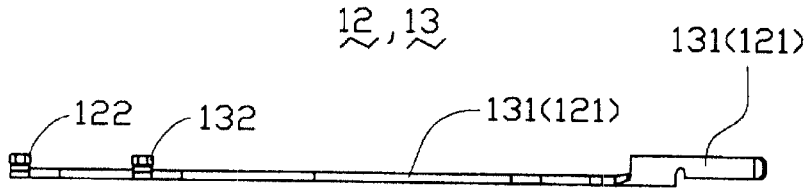
FIG. 1I is a bottom view of FIG. 1H.
Figure 1J:
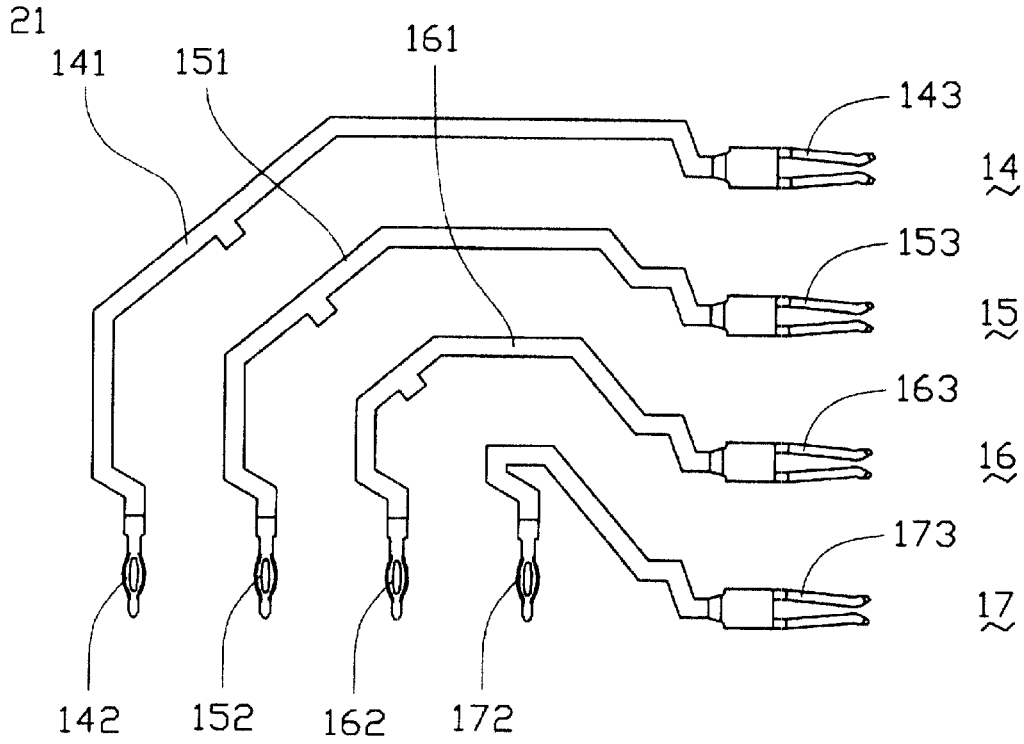
FIG. 1J is a front view second group of terminals.

As shown in FIG. 1A, and also FIGS. 1H, 1I, and 1J, the terminals 12 and 14 are terminal pair, while terminals 13, 15 are terminal pair. Since the terminals 12, 14 and 13, 15 are identical except to their length, only one description is given for simplicity. In order to easy description, terminals 12 and 13 are referred to first terminal in the pair, while terminals 14 and 15 are referred to second terminal in the pair.

Figure 1K:
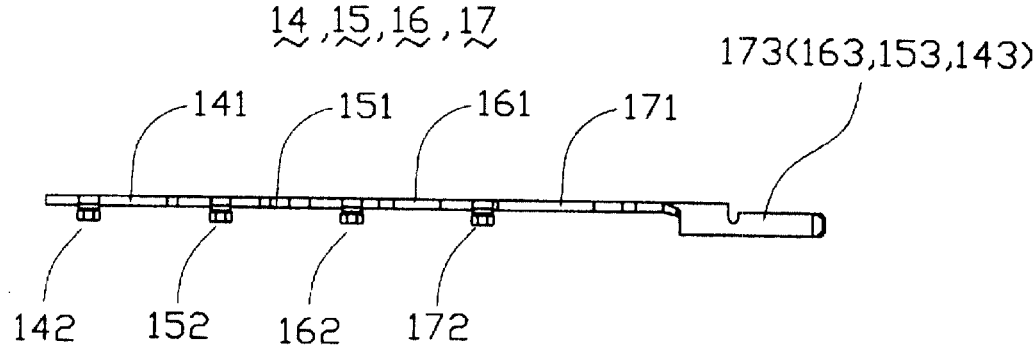
FIG. 1K is a bottom view of FIG. 1J.
Figure 2:
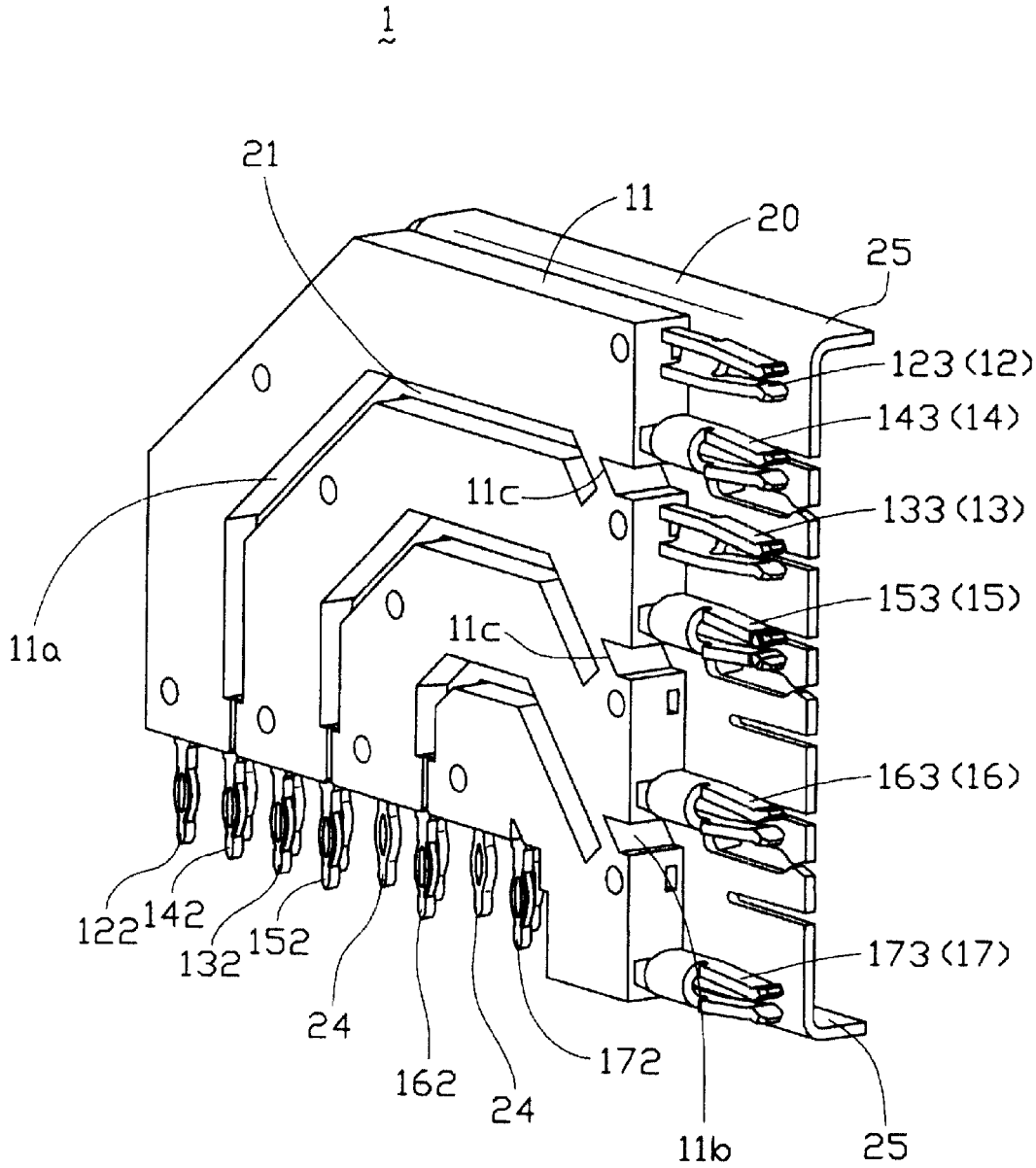
FIG. 2 is an assembled view of FIG. 1A.
Figure 3B:
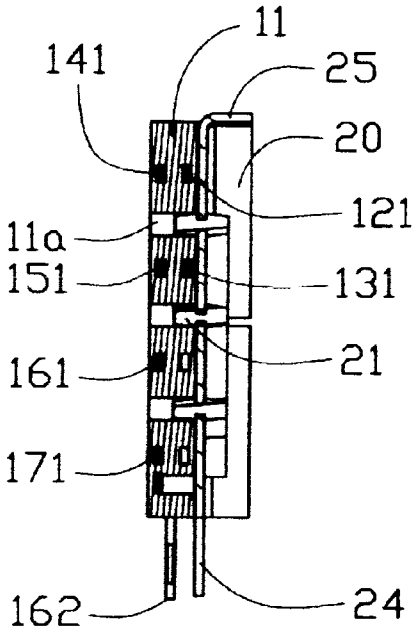
FIG. 3B is a cross sectional view taken along line A—A of FIG. 3A.

Each first terminal includes a first base portion 121 (131), a first tail portion 122 (132), and a first mating portion 123 (133). As shown in FIG. 1I, the first tail portions 122 (132) are offset upward from the first base portion 121 (131). Each second terminal includes a second base portion 141 (151), a second tail portion 142 (152), and a second mating portion 143 (153). As shown in FIG. 1K, the second tail portions 142 (152) are offset downward from the second base portion 141 (151). By this arrangement, when the first and second terminals 12 (13), and 14 (15) are stacked together, the first and second tail portions 122 (132) and 142 (152) are located in the same plane, such as shown in FIGS. 2 and 3B, while the first mating portions 123 (133) and the second mating portions 143 (153) are also located in the same plane.

On the other hand, the first mating portions 123 (133) are offset upward from the base portions 121 (131), while the second mating portions 141 (151) are offset downward from the base portions 141 (151). Again, when the first and second terminals 12 (13), and 14 (15) are stacked together, the sequential order of the mating portions 123 (133), and 143 (153) will become 123, 143, 133, and 153. As a matter of fact, the first and second tail portions 122 (132), and 142 (152) have the same arrangement.

Accordingly, by the offset arrangement of the mating portions 122 (142), and 132 (152), and the tail portions 123 (143), and 133 (153), the terminal 12 has the same length with the terminal 14, while the terminal 13 has the same length with the terminal 15. By this arrangement, the skew between the terminals 12, 14, and 13, 15 are completely eliminated.

Figure 5A:
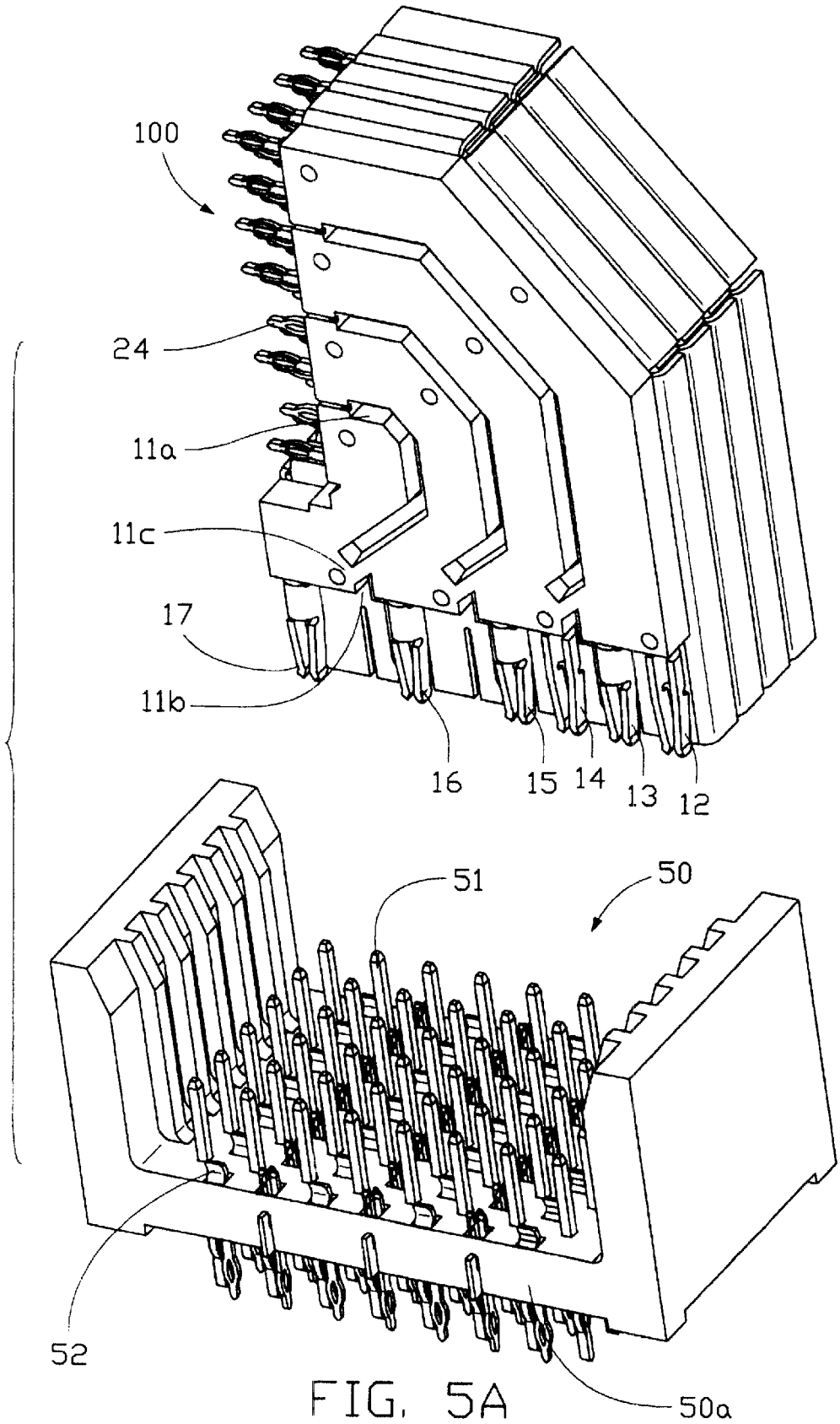
FIG. 5A is a perspective view of the electrical connector to be mated with a header.

The mating portions 122 (142), 132 (152), 162, and 172 are embodied as a socket to be mated with corresponding headers, FIG. 5A. However, it can be embodied with other configuration.

The plastic slab 11 is generally a plastic material integrally enclosing the terminals 12, 13, 14, 15, 16 and 17. The slab 11 is defined with a plurality of openings 11*a* which are located between two adjacent terminals 11, 12. The slab 11 is further defined with undercut 11*b* adjacent to a mating edge 11*c* thereof. The openings 11*a* and the undercuts 11*b* are defined such that bridges 11*c* are formed therebetween. The bridges 11*c* formed thereof is use to increase the integrality of the slab 11.

In manufacturing, the first and second group terminals 12, 13, 14, 15, 16, and 17 are stacked together such that the tail portions 122, 142, 132, 152, 162, and 172 are located in the same plane, while the mating portions 123, 143, 133, 153, 163, and 173 are located in the same plane as well. Then the plastic slab 11 is over-molded over those terminals 12, 13, 14, 15, 16, and 17 with the tail portions 122, 142, 132, 152, 162, and 172, the mating portions 123, 143, 133, 153, 163, and 173 extended over the slab 11 for mating with corresponding printed circuit board and headers.

The ground bus 20 is stamped directly from a sheet metal. The grounding bus 20 is directly formed with a plurality of slots 20*a* corresponding to the contour of the terminals 12, 13, 14, 15, 16, and 17. Each slot 20*a* is further formed with the grounding ribs 21 through the die-cast molding. Accordingly, when a plurality of ribs 21 is formed, a plurality of passage 22 is also defined between two adjacent ribs 21. The passage 22 is defined corresponding to the terminals 12, 13, 14, 15, 16, and 17. As clearly shown in FIG. 3B, each grounding rib 21 extends into the corresponding opening 11*a* of the slab 11. Accordingly, the terminals 12, 14 are located within the corresponding passage 22, while the terminals 13, 15 are located in the same passage 22, while the terminals 16 and 17 are located within the corresponding passages 22, respectively. By this arrangement, each terminals or terminal pair are electrically shielded from each other by the passages 22 defined by the grounding bus 20 and corresponding grounding ribs 21.

The grounding bus 20 further defines a plurality of short ribs 23 distant to the grounding ribs 21. As a result, gaps 26 are defined between the grounding ribs 21 and the short ribs 23. The gaps 26 are formed to receive bridges 11*c* of the slab 11. The short ribs 23 can be readily received in the undercut 11*b* of the slab 11. By this arrangement, the mating portions (123, 143), (133, 153), 163, and 173 are also electrically separated by the short ribs 23. Accordingly, an excellent shield performance is achieved by the arrangement provided by the present invention.

Figure 5B:
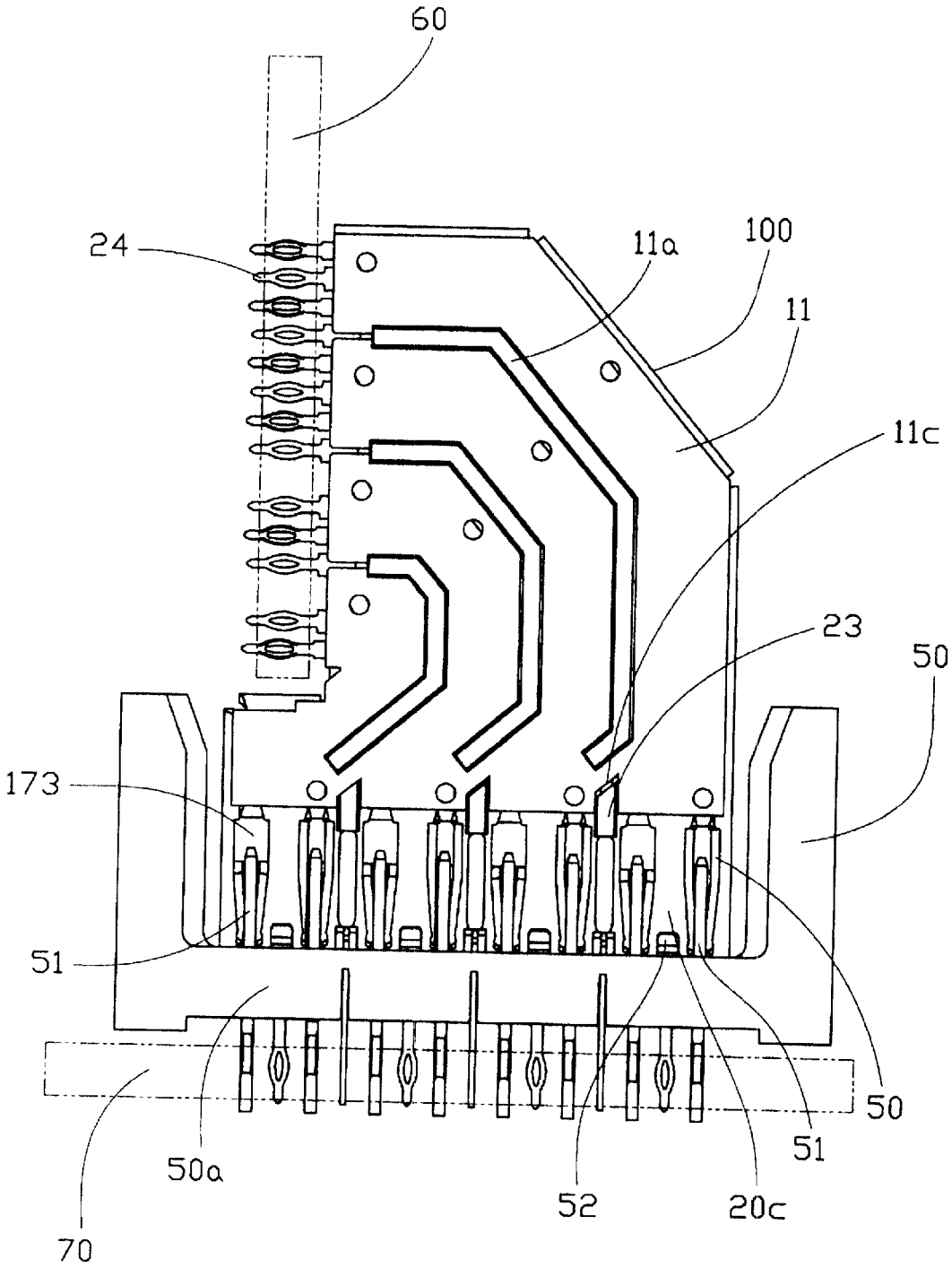
FIG. 5B is a side view of an electrical connector assembly mounted on printed circuit boards.

The grounding bus 20 is further integrally formed with a plurality of grounding legs 24 for mounting to the printed circuit board, such as shown in FIG. 5B. Forming of the grounding legs 24 is only possible by the stamping process. According to the preferred embodiment of the present invention, the grounding legs 24 each has a needle-eye configuration which is electrically connected to a through hole of the printed circuit board once the grounding leg 24 is inserted therein.

The grounding bus 20 further includes peripheral walls 25 which jointly define a receiving space 20*c* in which the wafer 10 can be snugly received therein, such as shown in FIG. 1D. By this arrangement, the wafer 10 is completely shielded by the corresponding grounding bus 20.

FIG. 2 is an assembled view of FIG. 1A. The arrangement shown in FIGS. 1A and 2 are just for easy understanding of the present invention. In the actual practice, the wafer 10 is completely enclosed the corresponding grounding bus 20.

Figure 3A:
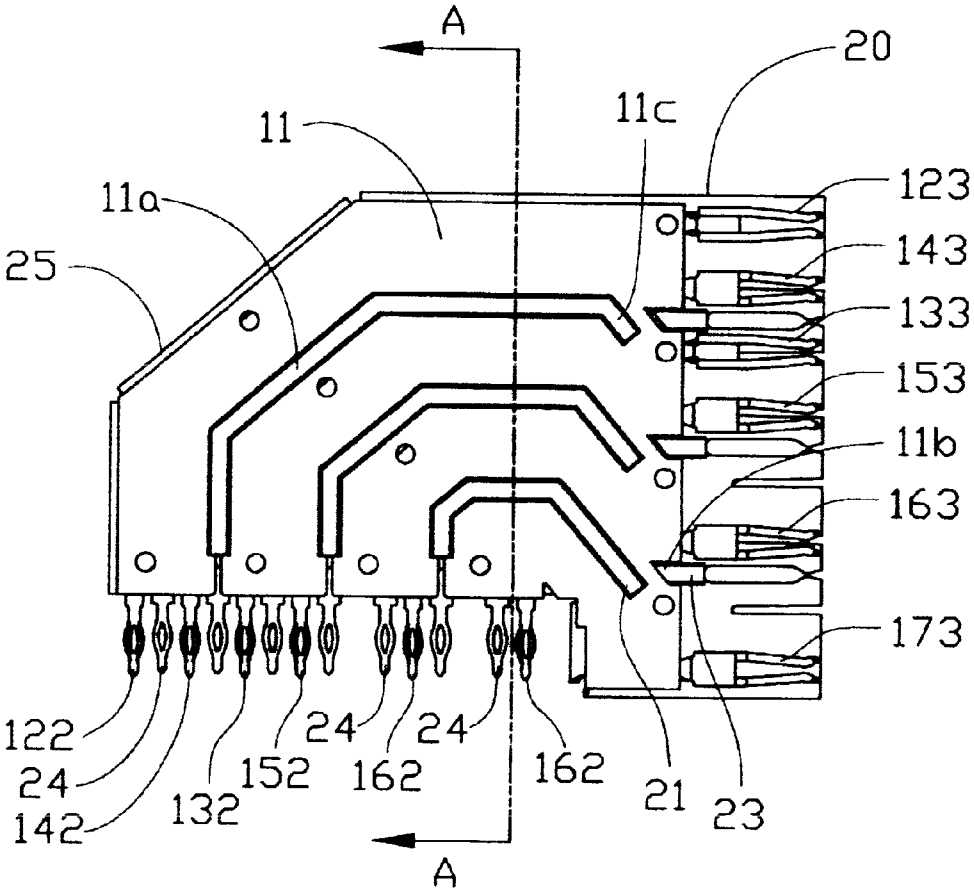
FIG. 3A is a side view of FIG. 2.

FIG. 3A is a front view of FIG. 2, while FIG. 3B is a cross sectional view taken along line A—A of FIG. 3A. It can be readily seen from FIG. 3B, the base portions 121, 141, and 131, 151 are arranged in a side-by-side arrangement, thereby benefiting skew-free signal transmission.

FIGS. 4A to 4D disclose a high density connector 100 configured by four sets of wafers 101, 102, 103 and 104, and grounding buses 201, 202, 203, and 204 are stacked together to define a high density electrical connector 100. Since the wafers 101, 102, 103 and 104 are identical to wafer 10, no detailed description is given. In addition, similar elements are marked with same numeral references as wafer 10. The grounding buses 201, 202, 203 and 204 are also identical to grounding bus 20, no detailed description is given. Besides, similar elements bear the same numeral references as grounding bus 20.

Figure 4B:
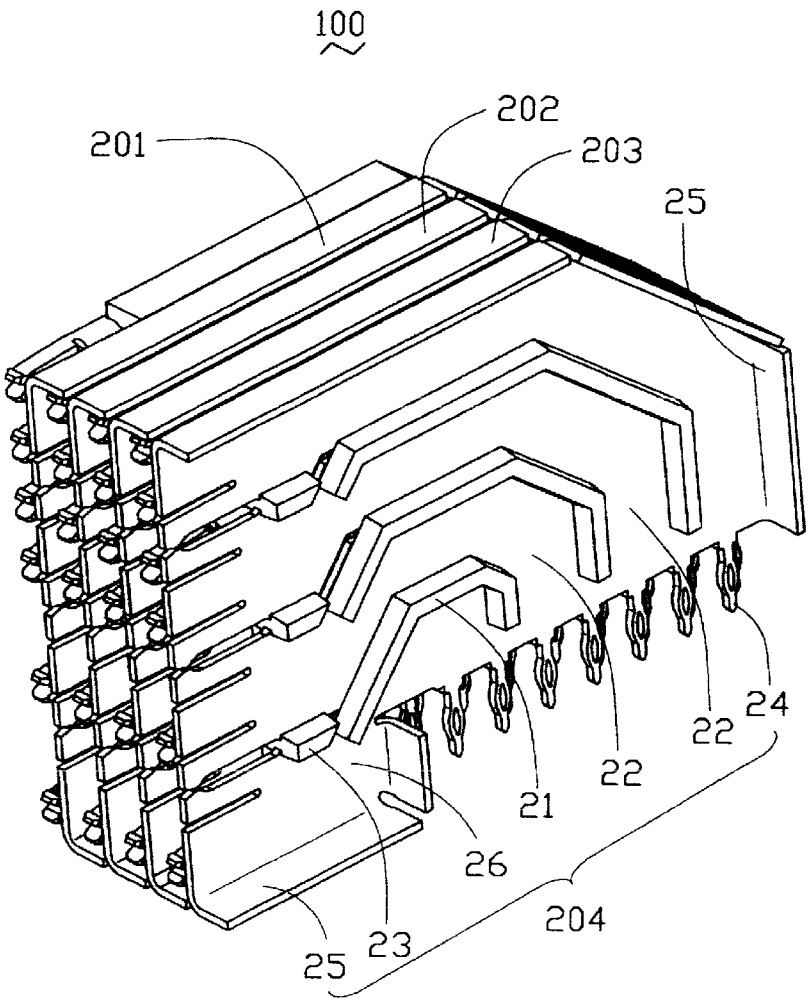
FIG. 4B is similar to FIG. 4A viewed from a reverse direction.
Figure 4A:
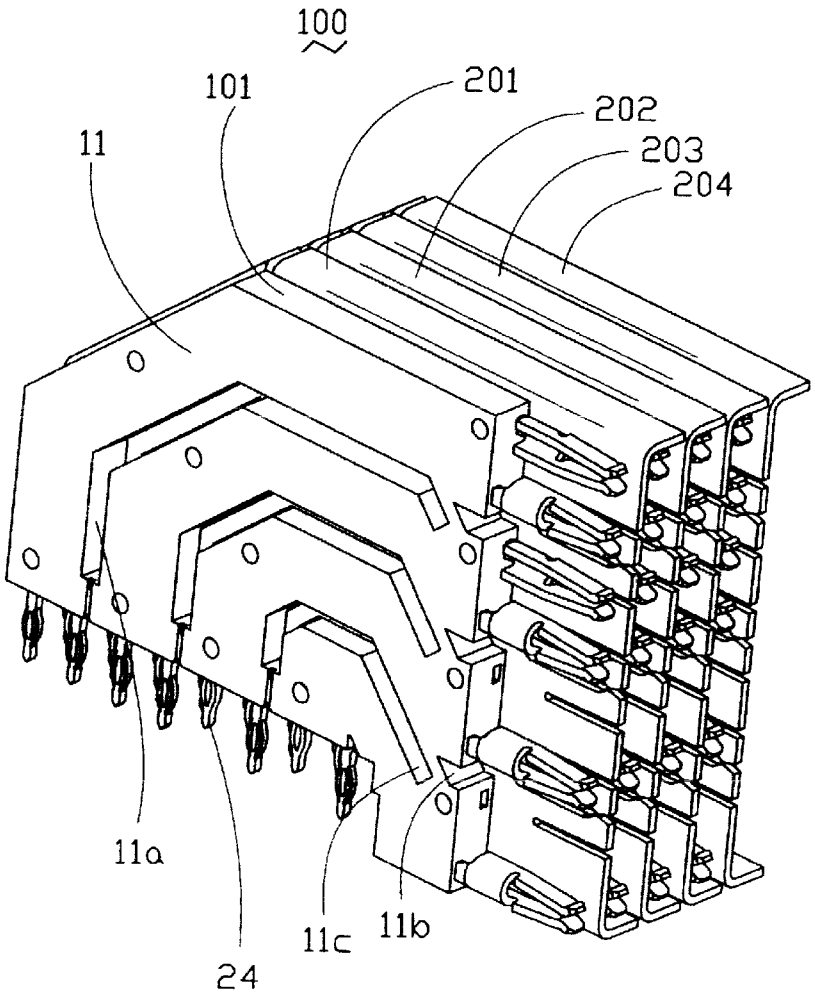
FIG. 4A is a perspective view of an electrical connector configured by a plurality of wafers shown in FIG. 2.
Figure 4D:
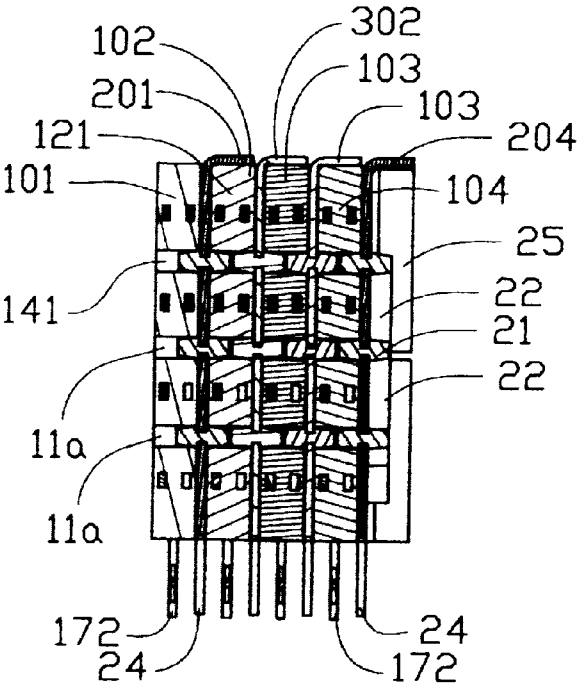
FIG. 4D is a cross sectional view taken along line FF–FF of FIG. 4C.
Figure 4C:
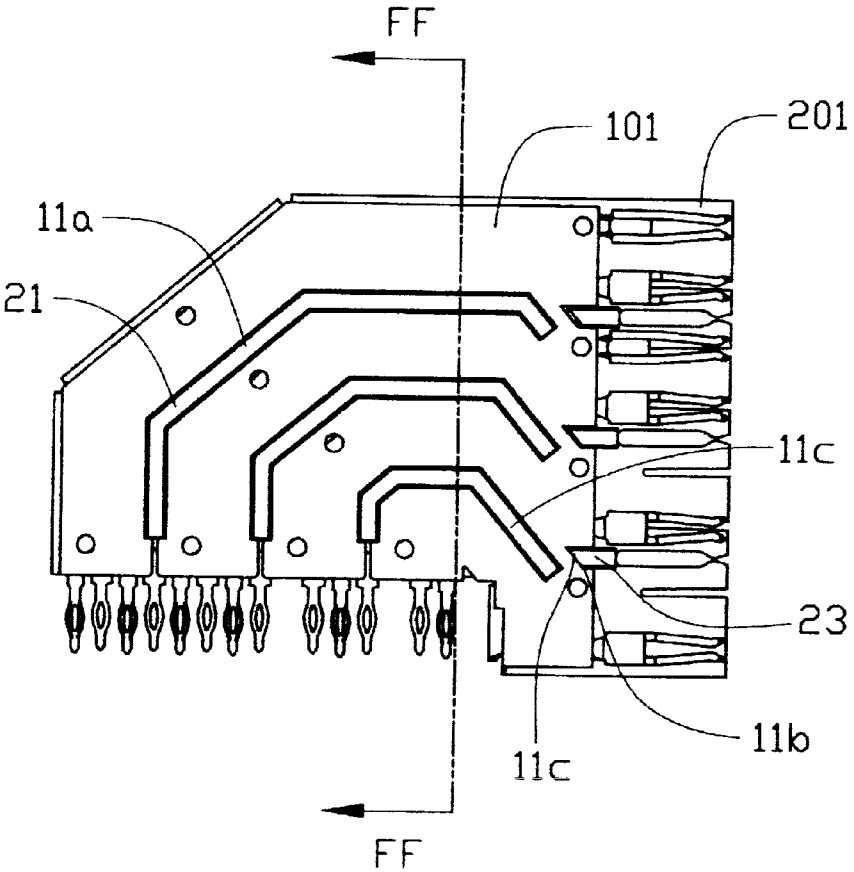
FIG. 4C is a side view of FIG. 4A.

FIGS. 4C is a front view of FIG. 4A, while FIG. 4D is a cross sectional view taken along line FF—FF of FIG. 4C. It can be readily seen that the wafers 102, 103 and 104 are enclosed by the corresponding grounding buses 201, 202, 203, and 204. In addition, the base portions 121, 141 of the terminals 12 and 14 are located within a passage 22 defined by the grounding bus 201 and the corresponding grounding ribs 21, for example. By this arrangement, the signal transmitted by the terminals 12 and 14 is completely shielded from noise. In addition, the terminals 12, 14 and 13, 15 are completely and electrically isolated by the grounding ribs 21 disposed therebetween. As a result, cross-talks between the terminal pairs 12, 14, and 13, 15 are completely eliminated.

Figure 4E:
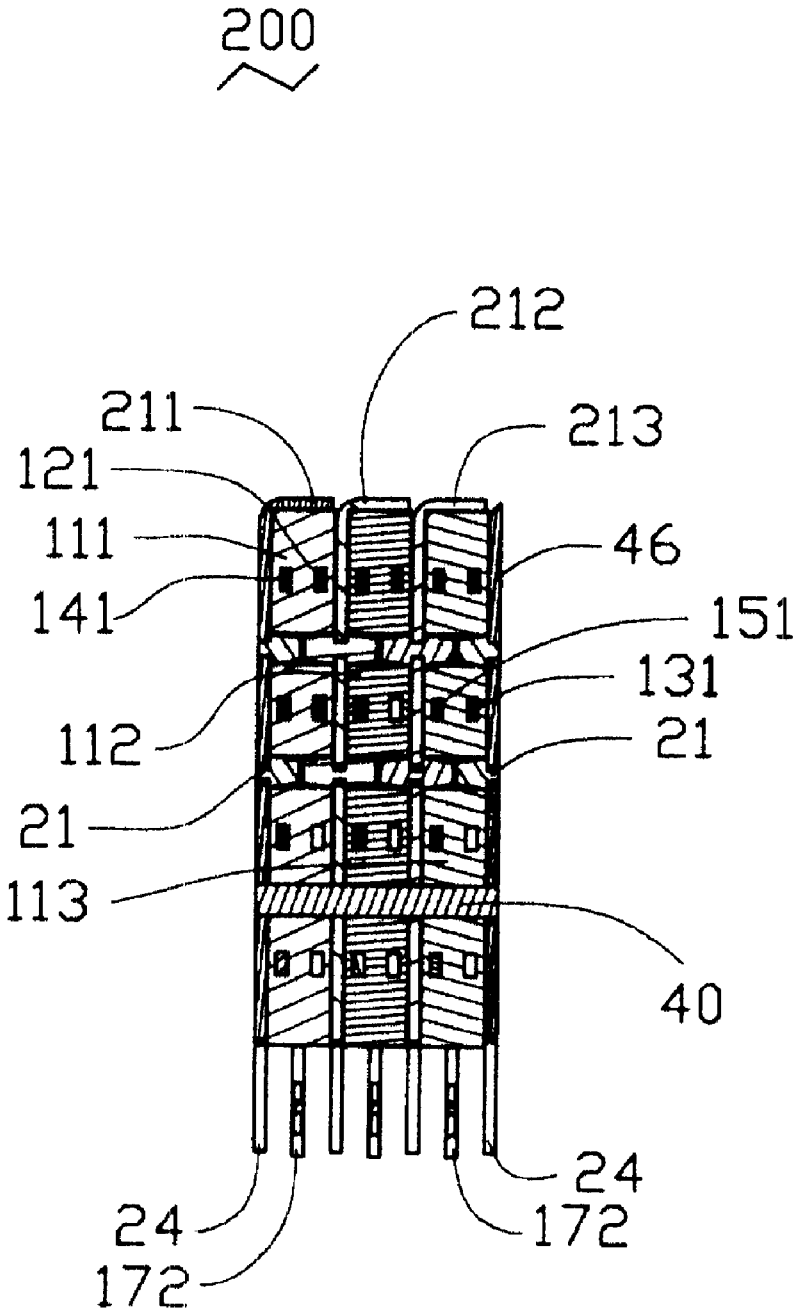
FIG. 4E is a cross sectional view of another embodiment in accordance with the present invention.

FIG. 4E discloses another embodiment in accordance with the present invention. In this preferred embodiment, an electrical connector 200 configured by three wafers 111, 112, and 113 and the grounding buses 211, 212, and 213 are interlocked by a latch 40 which passes through the slots 20*a* of the grounding buses 211, 212, and 213, and the openings 11*a* of the wafers 111, 112, and 113 is disclosed. By this arrangement, all the wafers 111, 112, and 113, and the grounding buses 211, 212, and 213 are securely interlocked. In addition, an end plate 46 is attached to the outmost wafer 113 to completely and electrically enclosing the wafer 113 within the corresponding grounding bus 213. Accordingly, an electrical connector 300 configured by the wafers 111, 112, 113 grounding buses 211, 212, 213, and the end plate 46 is completely and electrically shielded.

FIG. 5A is a perspective view showing the connector 100 shown in FIG. 4A and a corresponding header 50 having an array of pin 51 extending therefrom.

The header 50 includes a base 50*a* with the pins 51 extending therefrom.

The pins 51 are arranged in rows and every two adjacent rows of pins 51 are interposed with a row of grounding tabs 52. The pins 51 are to be mated with the mating portions 123, 133, 143, 153, 163, and 173 of the terminals 12, 13, 14, 15, 16 and 17, while the grounding tabs 52 are electrically mated with front tabs 20*c* of the grounding buses 201, 202, 203 and 204. Accordingly, when the connector 100 is mated with the header 50, all signal transmission is free from noise and EMI shielding.

FIG. 5B is a front view showing the mating of the connector 100 and the header 50. The doted line showing the connector 100 is mounted onto a first printed circuit board 60, while the header 50 is mounted onto a second printed circuit board 70. Generally, the second printed circuit board 70 is a motherboard, while the first printed circuit board 60 is a daughter board.

As clearly described above, the terminals 12 and 14 are equally and closely arranged in side-by-side arrangement, the terminals 12 and 14 can naturally serve as a differential pair to enhance signal transmission therethrough. The terminals 13 and 15 have the same advantages.

In addition, since the terminals 12 and 14 have almost the same contour, the impedance between the terminals 12 and 14 are actually equal.

In light of this, by the arrangement of the present invention, the terminals 12, 14, and 13, 15 can perfectly reach the requirements to serve as differential pair as well as matched impedance, while the prior art can never reach.

It should be noted that even the terminals 16, 17 are not incorporated with a counterpart terminals, such as terminals 12, 13, those counterpart terminals can be readily incorporated so as to serve as a differential pairs, such as terminals 12, 14; and 13, 15.

The wafer 10 (110) disclosed above includes only six terminals (12, 13, 14, 15, 16, and 17), however, the terminals 17 and 16 can be also incorporated with additional terminals to construct a pair.

Figure 6A:
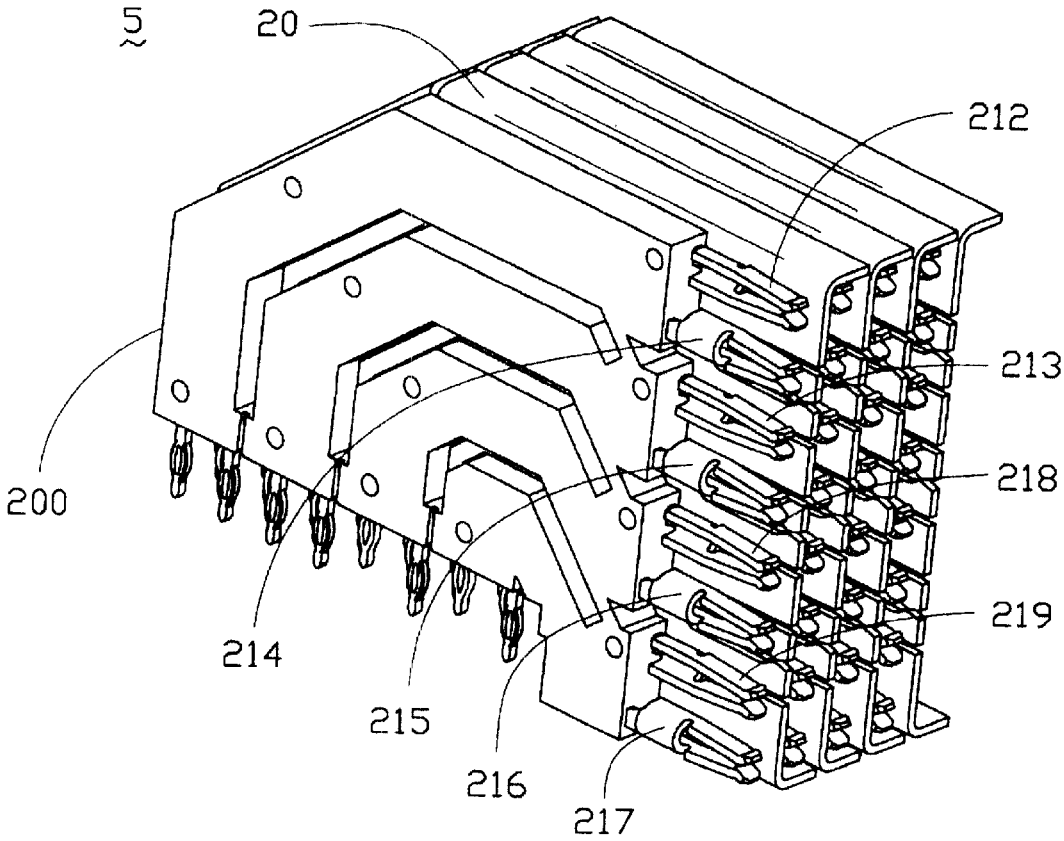
FIG. 6A is a perspective view of a connector in accordance with another embodiment of the present invention.

FIG. 6A discloses an electrical connector 5 which is configured by four wafers 210 each includes eight 212, 213, 214, 215, 216, 217, 218, and 219 in which terminals 212, 214 is a pair, while 213, 215 is a pair, 217, 219 is a pair, and 218, 216 is a pair.

Figure 6C:
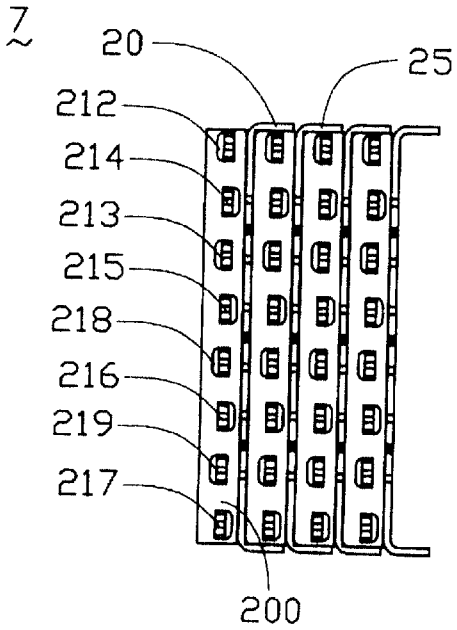
FIG. 6C is a front view of still another embodiment of the present invention.
Figure 6B:
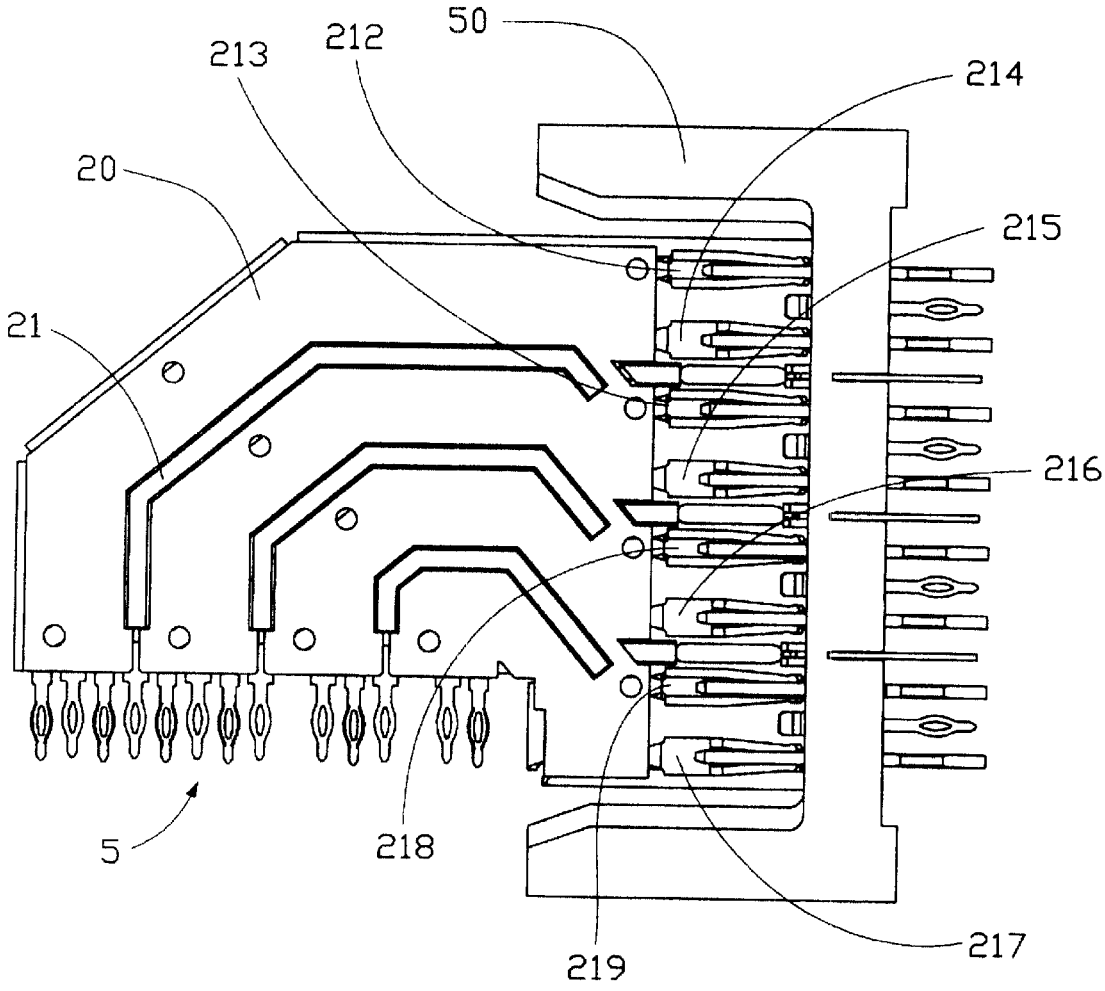
FIG. 6B is a perspective view showing the connector of FIG. 6A is mated with the header shown in FIG. 5A.

FIG. 6B is a side view showing the electrical connector 5 is mated with a header 50 shown in FIG. 5A.

FIG. 6C is a front view showing that an electrical connector 7 in accordance with the present invention includes seven wafers 210 and seven grounding bus 20. It can be readily appreciated that each pair of terminals 212, 214; 213, 215; 216, 218; and 217, 219 are located in a channel defined by the grounding bus 20 and the grounding ribs 21. By this arrangement, the signal transmission is reliably ensured.

The connector 7 shown in FIG. 6C demonstrates one of the advantages of the present invention, i.e. the connector 7 can be easily expanded by additional wafers 210. Each wafer 210 and grounding bus 20 serves as an unit which can be selectively increased to configure an electrical connector according to the requirements. As a result, a plurality of connector can be easily derived from a single unit, the wafer 210 and the grounding bus 20. The manufacturing cost is therefore tremendously reduced.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising a wafer integrally formed with a pair of terminal pairs and each pair configured by first and second terminals;

said first terminal including a first base portion having a first tail portion, and a first mating portion, said first tail and mating portions extending beyond said wafer;

said second terminal including a second base portion having a second tail portion, and a second mating portion, said second tail and mating portions extending beyond said wafer;

wherein said first and second base portions of said first and second terminals are spaced apart from each other in a side-by-side arrangement, said wafer includes openings between said terminal pairs which are distant from each other; and said electrical connector further includes a grounding bus having grounding ribs which project from both faces of said grounding bus and extend into said openings defined between terminal pairs of said wafer.

2. The electrical connector as recited in claim 1, wherein said grounding bus includes peripheral walls defining a receiving space to receive said wafer therein.

3. An electrical connector, comprising a wafer integrally formed with a pair of terminal pairs and each pair configured by first and second terminals;

said first terminal including a first base portion having a first tail portion, and a first mating portion, said first tail and mating portions extending beyond said wafer;

said second terminal including a second base portion having a second tail portion, and a second mating portion, said second tail and mating portions extending beyond said wafer;

a grounding bus attached to said wafer for providing EMI shielding, said grounding bus having grounding ribs which project from both faces of said grounding bus and extend into openings defined between terminal pairs of said wafer.

4. The electrical connector as recited in claim 3, wherein said grounding bus includes a plurality of pin legs.

5. An electrical connector, comprising at least a pair of wafers integrally formed with a plurality of terminals therein, said each wafer defining at least an opening between two adjacent terminals; and a grounding bus located between said wafers and forming grounding ribs, said grounding ribs extending from both faces of said grounding bus and into said opening of said wafers.

6. The electrical connector as recited in claim 5, wherein said grounding bus includes peripheral walls defining a receiving space to receive at least one wafer therein.

7. The electrical connector as recited in claim 5, wherein said terminals include at least two pair of terminal pairs having first and second terminals, said first terminal including a first base portion and said second terminal including a second base portion having a side-by-side arrangement with respect to said first base portion.

8. The terminal connector as recited in claim 7, wherein said first and second base portions have equal length.

9. The electrical connector as recited in claim 5, wherein said grounding ribs and said grounding bus jointly defining a shielded passage in which said terminal extends therethrough.

10. The electrical connector as recited in claim 9, further including a second grounding bus enclosing said shielded passage together with said first grounding bus and grounding ribs of said first grounding bus.

11. The electrical connector as recited in claim 9, wherein said second grounding bus includes second grounding ribs extending to said openings of one of said wafer.

12. The electrical connector as recited in claim 5, wherein each wafer includes at least of a pair of matched impedance terminals which are isolated by grounding ribs extended into the wafer.

13. The electrical connector as recited in claim 5, wherein each wafer includes at least of a pair of differential terminals which are isolated by grounding ribs extended into the wafer.

14. The electrical connector as recited in claim 5, wherein a latch extends through said wafers and said grounding bus for securely binding said wafers and said grounding buses together.

15. The electrical connector as recited in claim 5, further including an end plate attached to an outmost wafer such that said wafer is sandwiched between said end plate and a corresponding grounding bus.

16. The electrical connector as recited in claim 5, wherein said grounding bus forms peripheral walls surrounding said wafer therebetween.

* * * * *